US006655768B1

(12) United States Patent
Takagi

(10) Patent No.: US 6,655,768 B1
(45) Date of Patent: Dec. 2, 2003

(54) SEMICONDUCTOR INTEGRATED CIRCUIT, INK CARTRIDGE, AND INKJET RECORDING DEVICE

(75) Inventor: Tetsuo Takagi, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/857,472

(22) PCT Filed: Oct. 4, 2000

(86) PCT No.: PCT/JP00/06934

§ 371 (c)(1),
(2), (4) Date: Jul. 9, 2001

(87) PCT Pub. No.: WO01/26114

PCT Pub. Date: Apr. 12, 2001

(30) Foreign Application Priority Data

Oct. 4, 1999 (JP) ..... 11-283243

(51) Int. Cl.[7] ..... B41J 29/38
(52) U.S. Cl. ..... 347/5; 347/14
(58) Field of Search ..... 347/15, 19, 5, 347/14

(56) References Cited

U.S. PATENT DOCUMENTS 5,832,190 A 11/1998 Terajima et al. ..... 395/113
5,955,913 A 9/1999 Roohparvar ..... 327/534
6,065,824 A * 5/2000 Bullock et al. ..... 347/19
6,073,204 A * 6/2000 Lakhani et al. ..... 711/100
6,363,465 B1 * 3/2002 Toda ..... 711/169

FOREIGN PATENT DOCUMENTS

| | | |
|---|---|---|
| EP | 0 593 282 | 4/1994 |
| JP | 05-301349 | 11/1993 |
| JP | 09-116665 | 5/1997 |
| JP | 09-213092 | 8/1997 |
| WO | WO 96 05061 | 2/1996 |

* cited by examiner

*Primary Examiner*—Stephen D. Meier
*Assistant Examiner*—Lam Nguyen
(74) *Attorney, Agent, or Firm*—Rosalio Haro

(57) ABSTRACT

"A semiconductor integrated circuit can switch operation modes at proper timing and reduce a number of external terminals. By shifting to a low power consumption mode in response to an end of a printing operation by using an ink cartridge, an operation mode can be shifted without any effects on regular operations. In the low power consumption mode, a specified address can be initialized, resulting in an attempt for the reduction of power consumption. In the low power consumption mode, the power consumption can be reduced more by terminating operations of internal circuits including a sense amplifier, an address decoder, an output buffer, and a latch circuit. In addition, a chip-select terminal can be used to initialize circuit blocks and to shift to a stand-by mode, which results in a reduction of external terminals."

12 Claims, 9 Drawing Sheets

SEMICONDUCTOR INTEGRATED CIRCUIT, INK CARTRIDGE, AND INKJET RECORDING DEVICE

TECHNICAL FIELD

The present invention relates to a semiconductor integrated circuit having a non-volatile memory, an ink cartridge having the semiconductor integrated circuit, and an inkjet recording device having the ink cartridge attached.

BACKGROUND OF THE INVENTION

In general, a semiconductor integrated circuit consumes electronic power as long as a power supply is supplied even when a predetermined operation is not performed. Thus, there is a need for suppressing the power consumption as much as possible in a stand-by condition where a predetermined operation is not operated. In order to address such a need, it may be possible to add a function for shifting operation modes from a general operation mode to a low power consumption operation mode (called stand-by mode, below) to a semiconductor integrated circuit. In this way, when adding the function for shifting to the stand-by mode, timing for switching modes is important. That is, shifting to the stand-by mode at an arbitrary time may have an influence on regular operations. Thus, it is necessary to switch modes at proper timing.

Further, in order to provide a semiconductor integrated circuit with the function for switching operation modes, it is necessary to provide a control terminal for receiving control signals for the operation mode shifting. Then, the operation modes can be changed to the stand-by mode by giving control signals at a predetermined electric potential level to a control terminal for operation mode switching.

By the way, when a plurality of semiconductor integrated circuits are used in one system, a select signal is required for selecting from among the plurality of semiconductor circuits. In this case, it is required to provide a device selector terminal for selecting each of a plurality of devices.

Furthermore, it is common to provide a control terminal for circuit block initialization in the semiconductor integrated circuit in order to obtain a function for initializing built-in circuit blocks. In addition, when the circuit blocks are initialized, an internal condition can be set at a predetermined value by supplying a control signal at a predetermined electric potential to the control terminal for circuit block initialization.

In the semiconductor integrated circuit, in order to realize the operation mode switching function and the circuit block initialization function, the control terminal for the above described function is provided as an independent external terminal along with external terminals of a semiconductor integrated circuit typically including a high potential power supply input terminal, low potential power supply input terminal, and a reference clock signal input terminal, for example.

However, the semiconductor integrated circuit having the above-described function for shifting to the stand-by mode, the device selecting function, and the circuit block initialization function must include each of a control terminal for memory initialization and a control terminal for operation mode switching. Thus, there have been problems as described below.

That is, an increase in a number of control terminals requires a space where terminals are provided on the outside of the semiconductor integrated circuit. As a result, it causes a problem that the chip size within the semiconductor integrated circuit is increased. In addition, the increase in the number of the control terminals means an increase in the number of signal external wiring for external chips communicating with the present chip, resulting in a problem of increased implementation costs.

Further, in order to realize each of the functions in the semiconductor integrated circuit, it is necessary to generate each of the control signals for input to the control terminal for circuit block initialization and the control signals for input to the control terminal for operation mode switching. Furthermore, since these control signals must be supplied at desired timing, there is a problem that control gets more complicated.

The present invention was made in order to overcome the above-described problems of the conventional technology. A purpose of the present invention is to provide a semiconductor integrated circuit, which allows switching of operation modes at proper timing and reduction of a number of external terminals.

SUMMARY OF INVENTION

A semiconductor integrated circuit according to the present invention has a low power consumption mode that is lower in power consumption than a regular operation mode performing a regular operation and is implemented in an ink cartridge. The semiconductor integrated circuit includes a control unit for controlling a shift to the low power consumption mode in response to an end of a printing operation using the ink cartridge. The semiconductor integrated circuit may further includes a storage unit for storing predetermined data at a specified address, and an address creating unit for sequentially creating addresses specified for the storage unit. In this case, the address is initialized when shifting to the low power consumption mode by the control unit.

Further, the operation of internal circuits including a sense amplifier for creating a signal for reading out data stored in the storage unit, an address decoder for specifying an address in the storage unit, a buffer used for reading out data read out from the storage unit, and a latch circuit for latching data read out from the storage unit may be terminated in the low power consumption mode shifted to by the control unit.

Another semiconductor integrated circuit according to the present invention may perform a shift to the low power consumption mode by the control unit and an initialization of address created by the address creating unit by means of a control signal input from a common external terminal. The common external terminal may be a chip-select terminal.

An ink cartridge according to the present invention has the above-described semiconductor integrated circuit for storing at least the remaining amount of ink.

An inkjet recording device according to the present invention has the above-described ink cartridge for printing desired image information by using ink supplied from the ink cartridge.

BEST MODE FOR CARRYING OUT THE INVENTION

Figure 1:
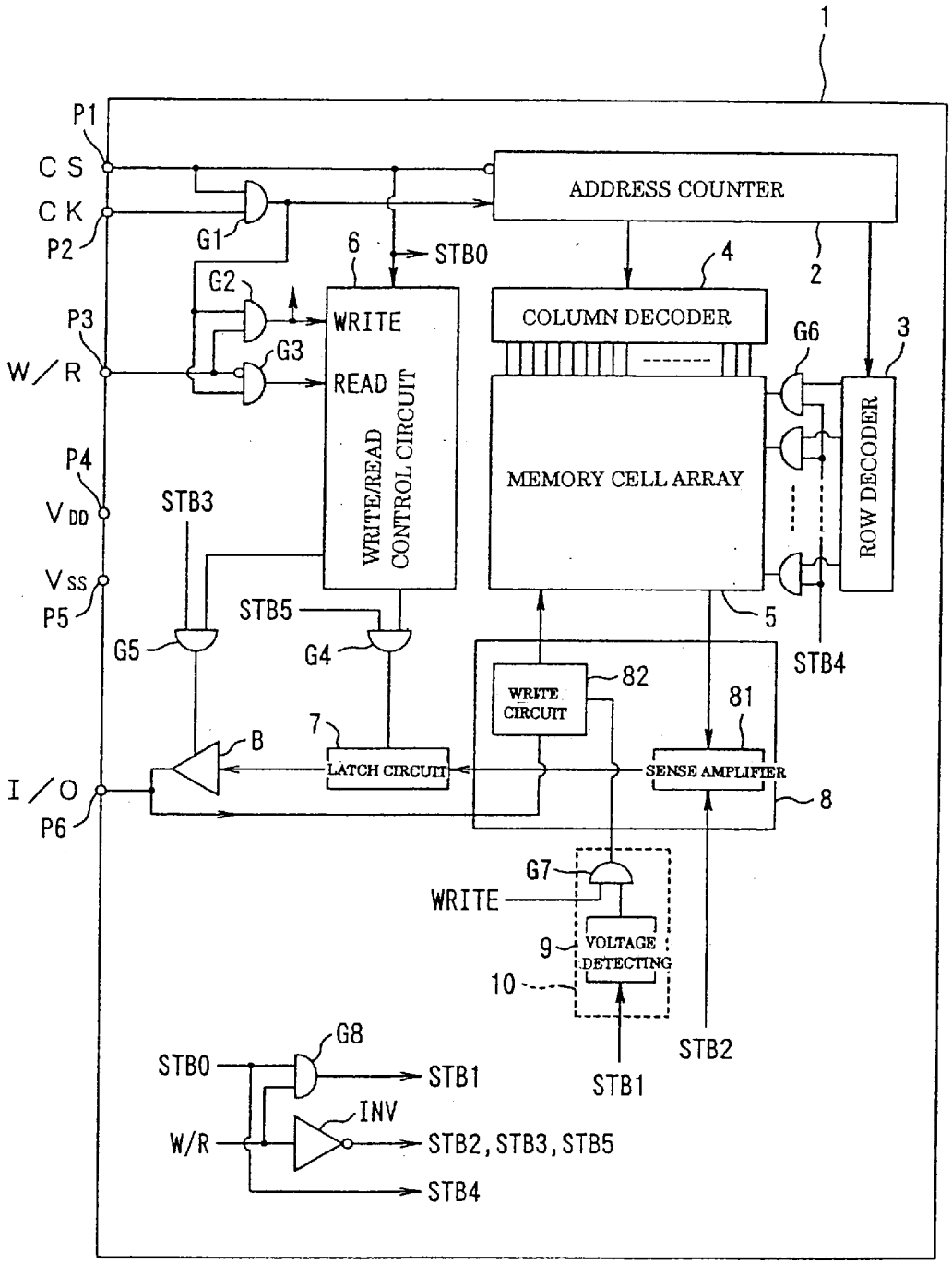
FIG. 1 is a functional block diagram for describing an example of an internal construction of a semiconductor integrated circuit according to the present invention.

Next, an embodiment of the present invention will be described with reference to drawings. In each of the drawings referenced in descriptions below, parts identical to those in other drawing are indicated by identical reference numerals.

FIG. 1 is a functional block diagram for describing an internal construction of a semiconductor integrated circuit in this embodiment. As shown in the figure, a semiconductor integrated circuit 1 according to this embodiment includes an address counter 2 for performing a count operation, a row decoder 3 and a column decoder 4 for decoding a count value in the address counter 2 in order to create an address, a memory cell array 5 for storing data, a write/read control circuit 6 for controlling a latch circuit 7 and a buffer B depending on whether a writing-in operation or a reading-out operation is implemented on memory cell array 5. Latch circuit 7 is controlled by the write/read control circuit 6 to put it in a latch state or a pass through state. Buffer B is controlled by the write/read control circuit 6 to place it in an enable state or a high-impedance (Hi-Z) state. The semiconductor integrated circuit further includes an input/output control circuit 8 for controlling input and output of data to and from the memory cell array 5, AND gates G1 to G8, a voltage detecting circuit 9, and an inverter INV. Further, the semiconductor integrated circuit 1 is provided with external terminals P1 to P6.

The count value of the address counter 2 is initialized to a predetermined value based on an inverted signal of a chip-select input signal CS input from the external terminal P1. Further, the address counter 2 creates updated address data based on a signal input from the AND gate G1. The created address data is input to the row decoder 3 and the column decoder 4.

The column decoder 4 selects desired vertical column of memory cells in the memory cell array 5 based on address data input from the address counter 2. Similarly, the row decoder 3 selects a desired a horizontal row of memory cell in the memory cell array 5 based on address data input from the address counter 2. However, each output line of the row decoder 3 is provided with an AND an gate G6, and input to one input of each AND gate G6 is a stand-by signal STB4. Thus, when the stand-by signal STB4 is at low level, a horizontal rows of memory cells in the memory cell array 5 are not selected.

The memory cell array 5 is formed by arranging a plurality of memory cells in grids. Each memory cell is turned to an ON state by a select signal from the row decoder 3, while a select signal from the column decoder 4 enables information stored in the memory cell to be read and written. In this case, it is assumed that the memory cell array 5 is formed of non-volatile memory cells.

The write/read control circuit 6 determines whether a write or read operation is performed on the memory cell array 5 based on chip-select control signals CS input from the external terminal P1 and signals output from an AND gate G2 and G3. The write/read control circuit 6 outputs control signals to the latch circuit 7 through an AND gate G4. Therefore, when a stand-by signal STB5 is at a low level, the output of the AND gate G4 is at a low level, while when STB5 is at a high level, the output of the AND gate G4 is equivalent to the output signal from the write/read control circuit 6.

Based on a control signal from the write/read control circuit 6, the latch circuit 7 outputs read data of the memory cell array 5, which is output from the input/output control circuit 8, to an external terminal P6 after keeping it for a predetermined period of time., The latch circuit 7 performs either a latch operation or a pass through operation depending on the output of the AND gate G4. The latch circuit 7 performs the latch operation when the output of the AND gate G4 is at the low level, and the latch circuit 7 operates the pass through operation when the output of the AND gate G4 is at the high level. The latch operation is an operation for maintaining the output state. The pass through operation is an operation for sending out the input signal as an output signal as it is.

The buffer B is provided between the output of the latch circuit 7 and the external terminal P6. The buffer B is turned to an enable state or a high-impedance state depending on the output of the AND gate G5, which has as inputs a stand-by signal STB3 and a control signal from the write/read control circuit 6. The output for the AND gate G5 is at low level when stand-by signal STB3 is low while the output of the AND gate G5 is equivalent to the output signal of the write/read control circuit 6 when STB3 is at the high level. When the output of the AND gate G5 is at high level and the buffer B is in the enable state, the output of the latch circuit 7 is derived from the external terminal P6. On the other hand, when the buffer B is in the high-impedance state, a signal supplied to the external terminal P6 is input to the input/output control circuit 8. On the other hand, when the buffer B is in the high-impedance state, a signal supplied to the external terminal P6 is input to input/output control circuit 8.

The input/output control circuit 8 writes data input from the external terminal P6 to the memory cell array 5, or conversely, outputs data read out from memory cell array 5 to the external terminal P6 through the latch circuit 7 and the buffer B. The input/output control circuit 8 includes a sense amplifier 81 operated through a stand-by signal STB2, and a write circuit 82 for performing a write operation of data from terminal P6 into the memory cell array depending on output from a write inhibiting circuit 10.

The write inhibiting circuit 10 includes a voltage detecting circuit 9, and an AND gate G7 for controlling transmissions of WRITE signals to the write circuit 82 depending on the output. The voltage detecting circuit 9 monitors a power supply voltage. It detects that the power circuit voltage is at a required voltage or above and transmit a WRITE signal to the write circuit 82 through the AND gate G7. The stand-by signal STB1 turns the voltage detected output to the low level and current of the voltage detecting circuit to a minimum when it is at the low level.

The written data is, for example, an amount of remaining ink. By writing the amount of remaining ink, the amount of remaining ink can be always monitored.

When the stand-by signal STB1 is smaller than a predetermined voltage level, the output of the AND gate G7 is at the low level, and no data writing is performed on the memory cell array 5.

The AND gate G1 outputs, to the address counter 2 and the And gates G2 and G3, a signal which is a logic AND combination of a chip-select control signal CS input from the external terminal P1 and a clock input signal CK input from the external terminal P2.

The AND gate G2 outputs, to the write/read control circuit 6, a signal which is a logic AND combination of an output signal from the AND gate G1 and a write/read input signal W/R from the external terminal P3. On the other hand, the AND gate G3 outputs, to the write/read control circuit 6, a signal which is a combination of an output signal from the AND gate G1 and an inverted signal of the write/read input signal W/R from the external terminal P3.

More specifically, when the input signal from the AND gate G1 is "L", the outputs of the AND gates G2 and G3 are both "L". On the other hand, when the input signal from the AND gate G1 is "H", and a write/read input signal W/R is "H", the output of the AND gate G2 is "H" while the output of the AND gate G3 is "L". Conversely, if the write/read input signal W/R is "L", the output of the AND gate G2 is "L" while the AND gate G3 is "H". In this way, the AND gates G2 and G3 are arranged not to have unstable outputs even if the write/read input signal W/R varies.

The external terminal P1 is a terminal for inputting a chip-select input signal CS, that is a control signal STB for selecting a specific device when a plurality of devices exist at the same time, for initializing the address counter 2, and for shifting the operation mode. That is, the external terminal P1 in this embodiment is a terminal used both as a control terminal for initializing an address counter and as a control terminal for an operation mode.

The external terminal P2 is a terminal for inputting a clock input signal CK that is a reference for the semiconductor integrated circuit 1 to operate. The external terminal P3 is a terminal for inputting a write/read input signal W/R for specifying an access operation on the memory cell array 5 built in the semiconductor integrated circuit 1.

The external terminals P4 and P5 are input terminals for applying operational voltage at a high potential voltage level VDD and at a low potential voltage level Vss for the semiconductor integrated circuit 1 to operate. The external terminal P6 is an input/output terminal for inputting data to be actually written in the memory cell array 5 built in the semiconductor integrated circuit 1 and/or for outputting data read out from the memory cell array 5.

Each of the stand-by signals STB1 to STB5 is generated by an AND gate G8 and an inverter INV. The stand-by signal STB1 is generated by the AND gate G8, which outputs a logic AND combination of a stand-by signal STB0 and the write/read input signal W/R. Further, the stand-by signals STB2, STB3, and STB5 are generated by the inverter INV, which inverts and outputs the write/read input signal W/R. The stand-by signal STB0 becomes the stand-by signal STB4 as it is.

Next, operations of the semiconductor integrated circuit according to this embodiment will be described with reference to FIGS. 2 and 3.

Figure 2:
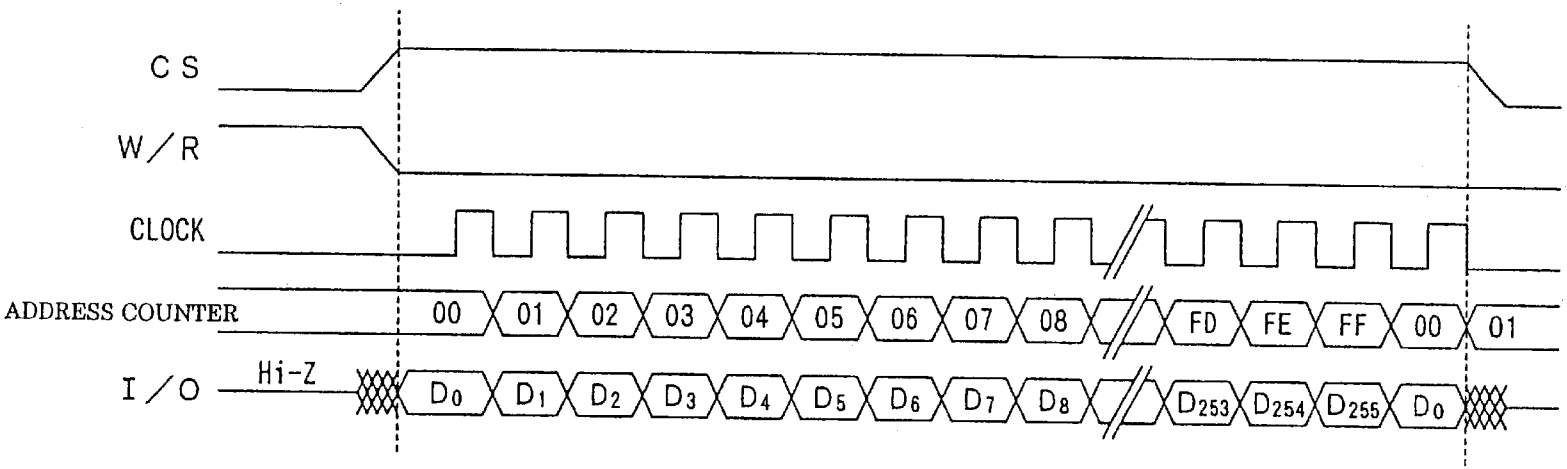
FIG. 2 is a timing chart for describing a read-out operation onto the semiconductor integration circuit.

FIG. 2 is a timing chart for describing a readout operation on a semiconductor integrated circuit. FIG. 2 shows the chip-select control signals CS, the write/read input signals W/R, the clock CLOCK, the count values of the address counter 2, and the input/output signals I/O in the external terminal P6 in FIG. 1. When the readout is performed on the memory cell array 5, the "L" is applied to the external terminal P1, first of all, to initialize the address counter 2. Next, "H" is applied to the external terminal P1, and clock pulses for a predetermined readout start address is input from the external terminal P2. During inputting the clock pulses, "L" is applied for specifying the readout is applied as a write/read input signal W/R from the external terminal P3.

The address corresponding to data is output in a period when the clock-input signal CK is turned to "L". During the period when the clock input signal CK is "H", the value is maintained since it is latched within the latch circuit 7 in the leading edge. In the trailing edge, the address is incremented, and data for the next address is output from the external terminal P6.

Figure 3:
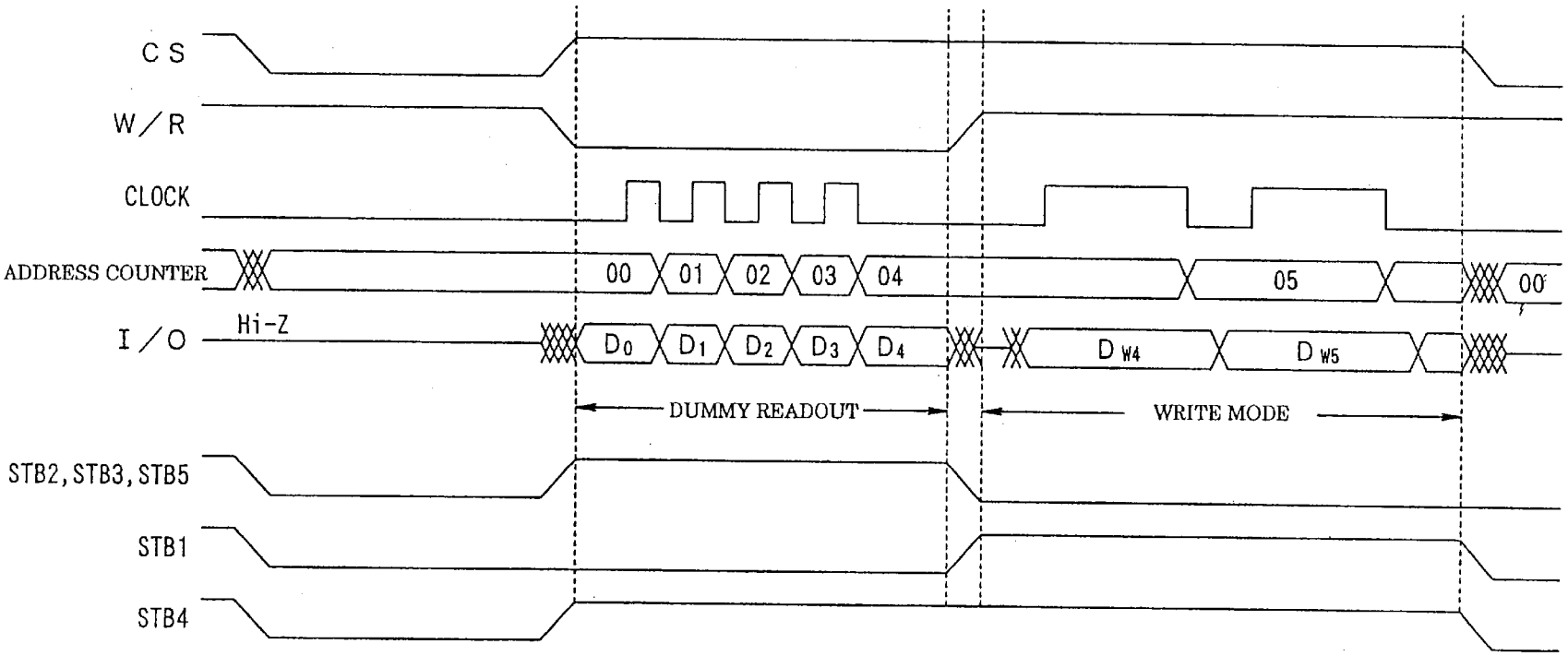
FIG. 3 is a timing chart for describing a write operation and the other from the semiconductor integrated circuit.

FIG. 3 is a timing chart for describing a write operation from the semiconductor integrated circuit, for example. FIG. 3 shows the chip-select control signals CS, the write/read input signals W/R, the clock CLOCK, the count values of the address counter 2, the input/output signals I/O in the external terminal P6 as well as the stand-by signals STB1 to STB5. When a write is performed on the memory cell array 5, "L" is applied to the external terminal P1 in a condition where the write/read input signal W/R is "L" in order to initialize the address counter 2. Next, "H" is applied to the external terminal P1, and clock pulses for an intended write start address are input from the external terminal P2. Then, while the write operation is performed, "H" for specifying the write operation is applied as the write/read input signal W/R from the external terminal P3.

Next, a process for instructing the semiconductor integrated circuit 1 for memory initialization and operation mode shifting will be described. As described above, when "L" is applied to the external terminal P1, the address counter 2 is initialized. This is a procedure absolutely required for initialization of the semiconductor integrated circuit 1 and the same is done for others including the write/read control circuit 6 than the memory cell array 5. Here, the output of the buffer B is turned to an i-Z state, which cause the external terminal P6 open (hi-impedance condition).

In addition, when printing by the inkjet recording device is completed, "L" is applied to the external terminal P1. Then, the stand-by signal STB for the operation mode shifting is turned to "L", and the operation mode of the semiconductor integrated circuit 1 is shifted to the stand-by mode. When the operation mode of the semiconductor integrated circuit 1 is shifted to the stand-by mode, a part where current steadily flow is terminated, which effects the reduction of the current consumption. More specifically, the sense amplifier 81 provided within the input/output control circuit 8, for example, usually includes a current mirror circuit, and the sense amplifier 81 always needs current flow. Therefore, in order to suppress power consumption, when it is at the stand-by mode, the source voltage to be supplied to the input/output control circuit 8 is turned to OFF by the stand-by signal STB2. Similarly, the voltage detecting circuit 9 including a current mirror circuit is turned to OFF by the stand-by signal STB1.

Further, the buffer B that is another internal circuit is turned to the high-impedance condition by the stand-by signal STB3. Furthermore, the latch circuit 7 is controlled to the latch condition by the stand-by signal STB5. In addition, specification of addresses by the row decoder 3 is suppressed by the stand-by signal STB4.

Thus, in this embodiment, when the chip-select input signal CS is "L", that is, when the external terminal P1 is in an unselect condition, the address counter 2 is initialized and the semiconductor integrated circuit 1 is shifted to the stand-by mode. Since these instructions are controlled by the inputs from the external terminal P1, that is a dual-usage terminal, the memory initialization function and the function for shifting to the stand-by mode are provided, attempting the reduction of the external terminals. Further, the control terminal for the memory initialization and the control terminal for operation mode control are coupled to one dual-usage terminal, which makes the control easier.

In this case, the functions for the circuit block initialization and the operation mode shifting may be arranged such that the address counter 2 is initialized and the semiconductor integrated circuit 1 is shifted to the stand-by mode when the logical output between the input from the external terminal P1 and the input from the other terminals are the unselect condition.

Figure 4:
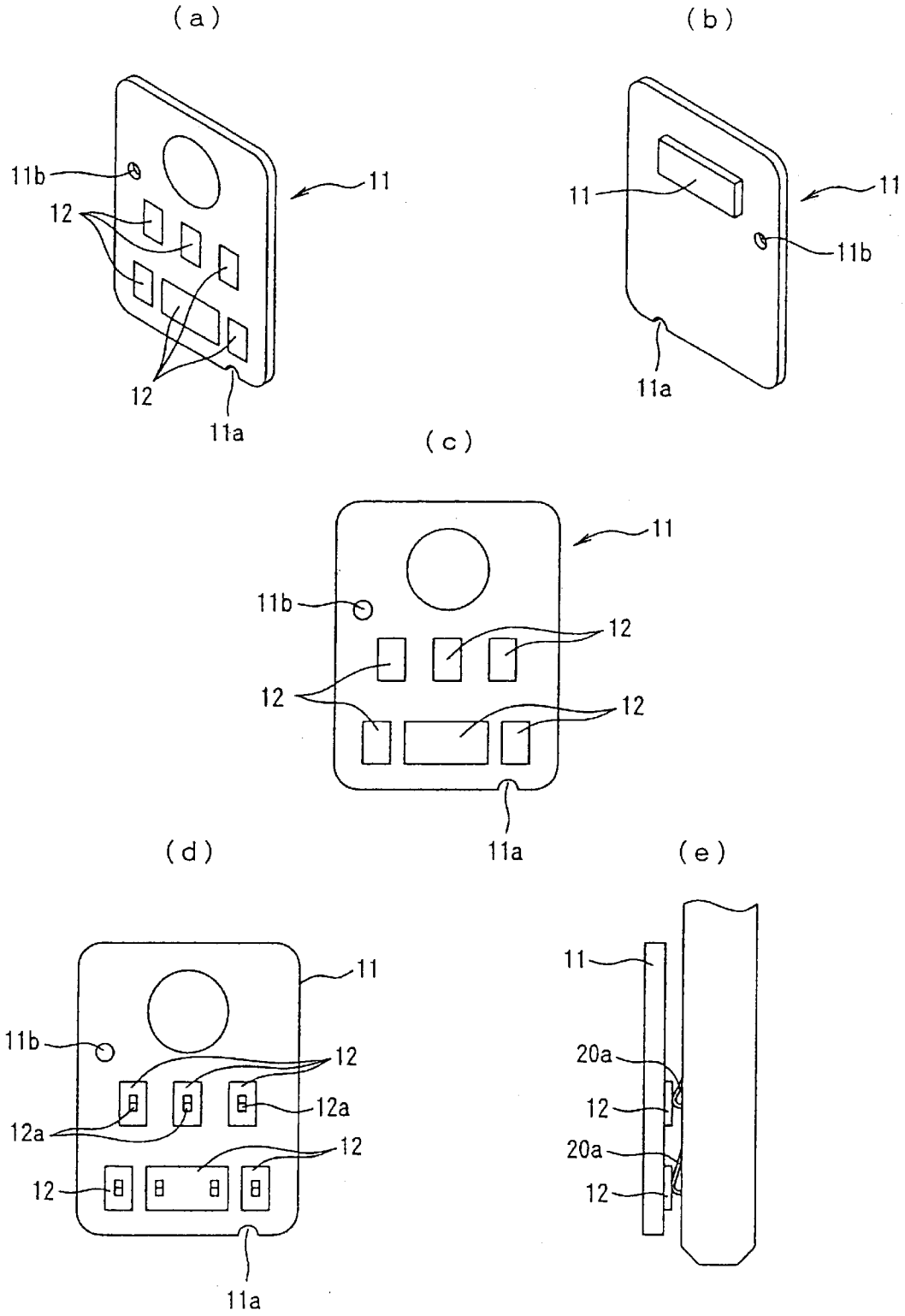
FIG. 4 is a diagram showing a circuit substrate on which the semiconductor integrated circuit in an embodiment is implemented.

FIGS. 4(*a*) to 4(*e*) are diagrams for showing a circuit substrate on which a semiconductor integrated circuit according to this embodiment is implemented. As shown in FIG. 4(*a*), contacts 12 are formed on a surface side of a circuit substrate 11. These contacts 12 are connected to the above-described external terminals P1 to P6. Further, as shown in FIG. 4(*b*), the semiconductor integrated circuit 1 is implemented on the back side of the circuit substrate 11.

As shown in FIG. 4(*c*), the circuit substrate 11 is in a substantially rectangular, plate form. The circuit substrate 11 is provided with a notch portion 11*a*, and a hole portion 11*b*. They are used for positioning the circuit substrate 11 when implemented on an ink-cartridge described below. Further, as shown in FIG. 4(*d*), a recess 12*a* may be provided on the surface of each of the contacts 12 provided on the circuit substrate 11. Providing the recess 12*a*, as shown in FIG. 4(*e*) improves the electric connection condition with a contact 29 provided on the ink cartridge described below.

Figure 5:
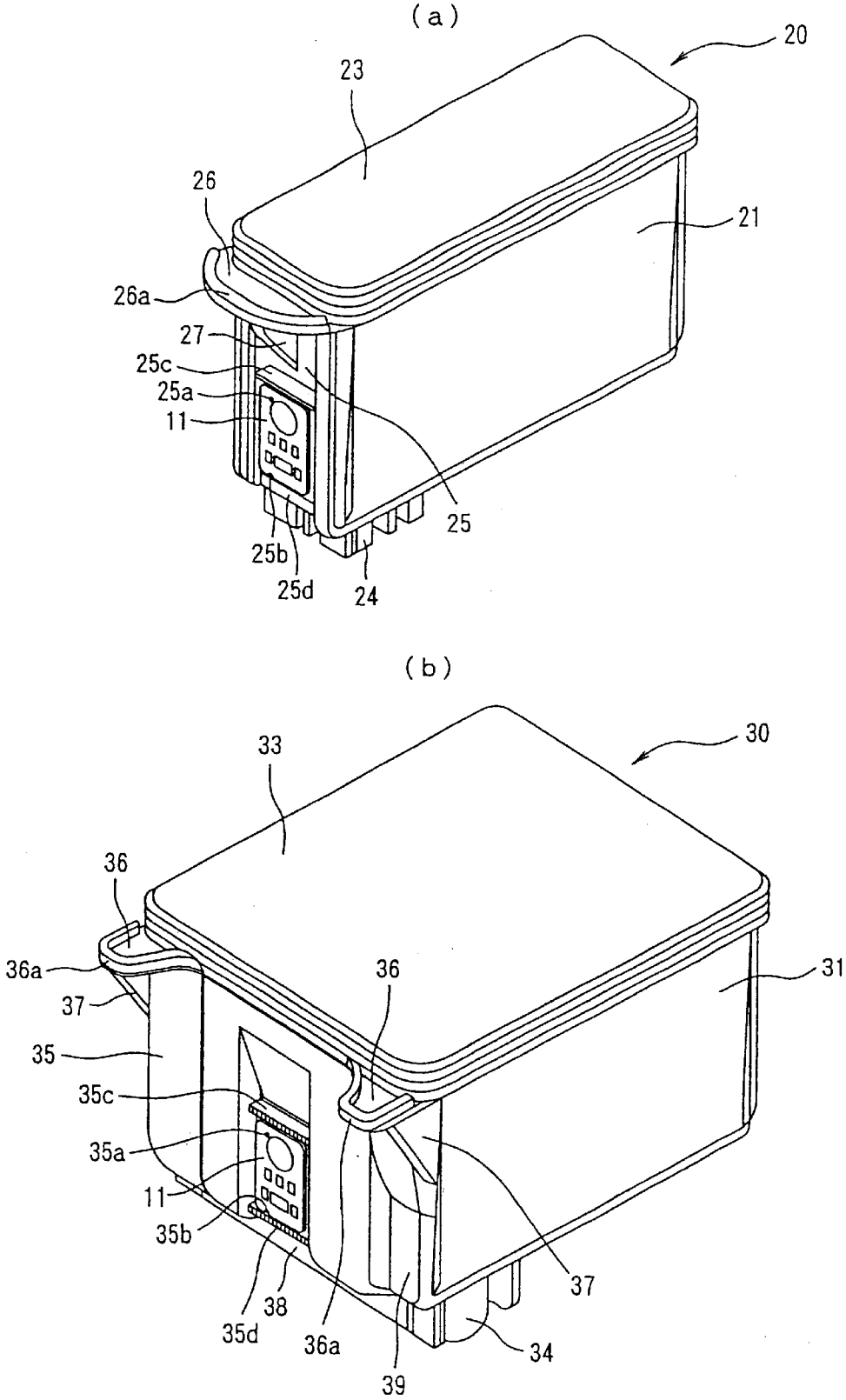
FIG. 5 is a diagram showing a condition where the circuit substrate shown in FIG. 4 is implemented on an ink cartridge.

FIGS. 5(*a*) and 5(*b*) are diagrams for showing a condition where the circuit substrate shown in FIG. 4 is implemented on an ink cartridge. FIG. 5(*a*) shows a condition where the circuit substrate 11 is implemented on a black ink cartridge 20 accommodating black ink. The black ink cartridge 20 accommodates, in a container 21 formed as a substantial rectangular parallelepiped, a porous body, not shown, impregnated with black ink, and the top surface is sealed by a lid body 23. On the bottom surface of the container 21, an ink supplying outlet 24 is formed at a position facing to an ink supplying needle when attached to a holder. In addition, an overhang portion 26 associated with a projection of a lever of the body is formed integrally at an upper edge of a vertical wall 25 at the side of the ink supplying outlet. The overhang portions 26 are formed on the both side of the wall 25 separately, and each has a rib 26*a*. Further, a rectangular rib 27 is formed between a bottom surface and the wall 25.

The circuit substrate 11 is attached at the side where the ink supplying outlet of the horizontal wall 25 is formed. The circuit substrate 11 has a plurality of contacts on a surface facing to the contacts of the body and has a memory element implemented on the back surface. In addition, projections 25*a* and 25*b* and overhang portions 25*c* and 25*d* are formed on the horizontal wall 25 in order to position the circuit substrate 11.

On the other hand, FIG. 5(*b*) shows a condition where the implemented circuit substrate 11 is implemented on a color ink cartridge accommodating color ink. The color ink cartridge 30 accommodates, in a container 31 formed as a substantially a rectangular parallelepiped, a porous body, not shown, impregnated with ink and sealed with a lid body 33 on the upper surface. Five ink accommodating portions accommodating five colors of color ink separately and respectively are sectionally formed inside of the container 51. At the bottom surface of the container 31,an ink supplying outlet 34 is formed depending on each ink color at a position facing to an ink supplying needle when attached to the holder. In addition, an overhang portion 36 associated with a projection of a lever of the body is formed integrally at an upper edge of a vertical wall 35 at the side of the ink supplying outlet. The overhang portions 36 are formed on the both side of the wall 35 separately, and each has a rib 36*a*. Further, a rectangular rib 37 is formed between a bottom surface and the wall 35. Furthermore, the container 31 has a recess 39 in order to prevent the mis-insertion.

A recess 38 is formed at a side of the horizontal wall 35 where an ink supplying outlet is formed such that it is positioned at the center of each cartridge 30 in the width direction, and the circuit substrate 11 is attached here. The circuit substrate 11 has a plurality of contacts on a surface facing to the contacts of the body and has a memory element implemented on the back surface. In addition, projections 35*a* and 35*b* and overhang portions 35*c* and 35*d* are formed on the horizontal wall 35 in order to position the circuit substrate 11.

Figure 6:
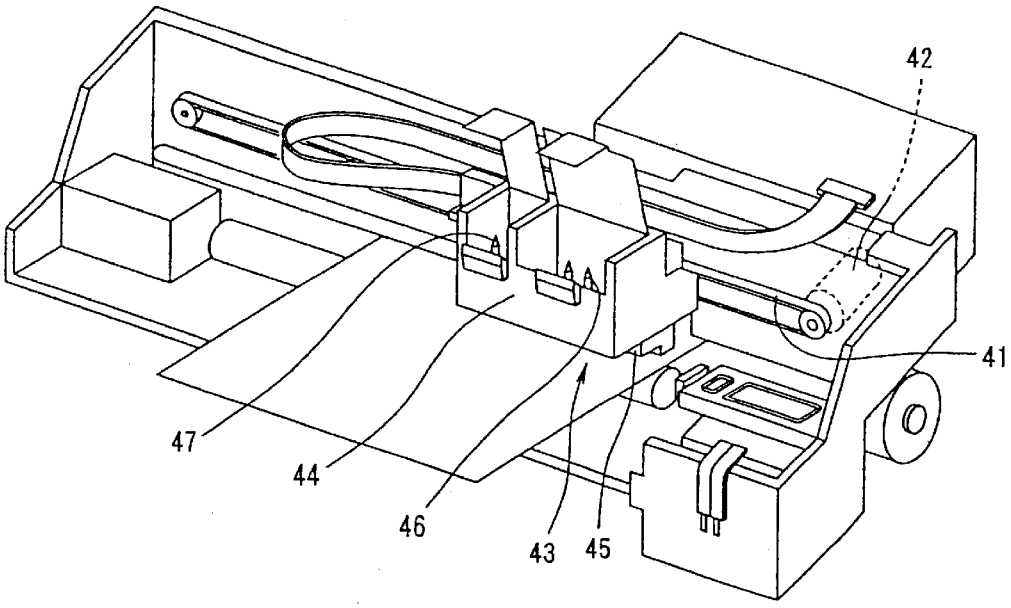
FIG. 6 is a diagram for showing an overview of an inkjet printer to which the ink cartridge shown in FIG. 5 is attached.

FIG. 6 is a diagram showing an overview of an inkjet printer (inkjet recording device) to which an ink cartridge shown in FIG. 5 is attached. In FIG. 6, a holder 44 for storing each of the black ink cartridge 30 shown in FIG. 5(*a*) and the color ink cartridge 30 shown in FIG. 5(*b*) is formed in a carriage 43 connected to a driving motor 42 through a timing belt 41. Further, a recording head 45 for receiving the supply of ink from each of the ink cartridges 20 and 30 at a bottom surface position on the carriage 43.

Ink supply needles 46 and 47 communicating with a recording head 45 is provided vertically on the bottom surface of the carriage 43 such that they are positioned at the inner part of the device, that is on the side of the timing belt 41.

Figure 7:
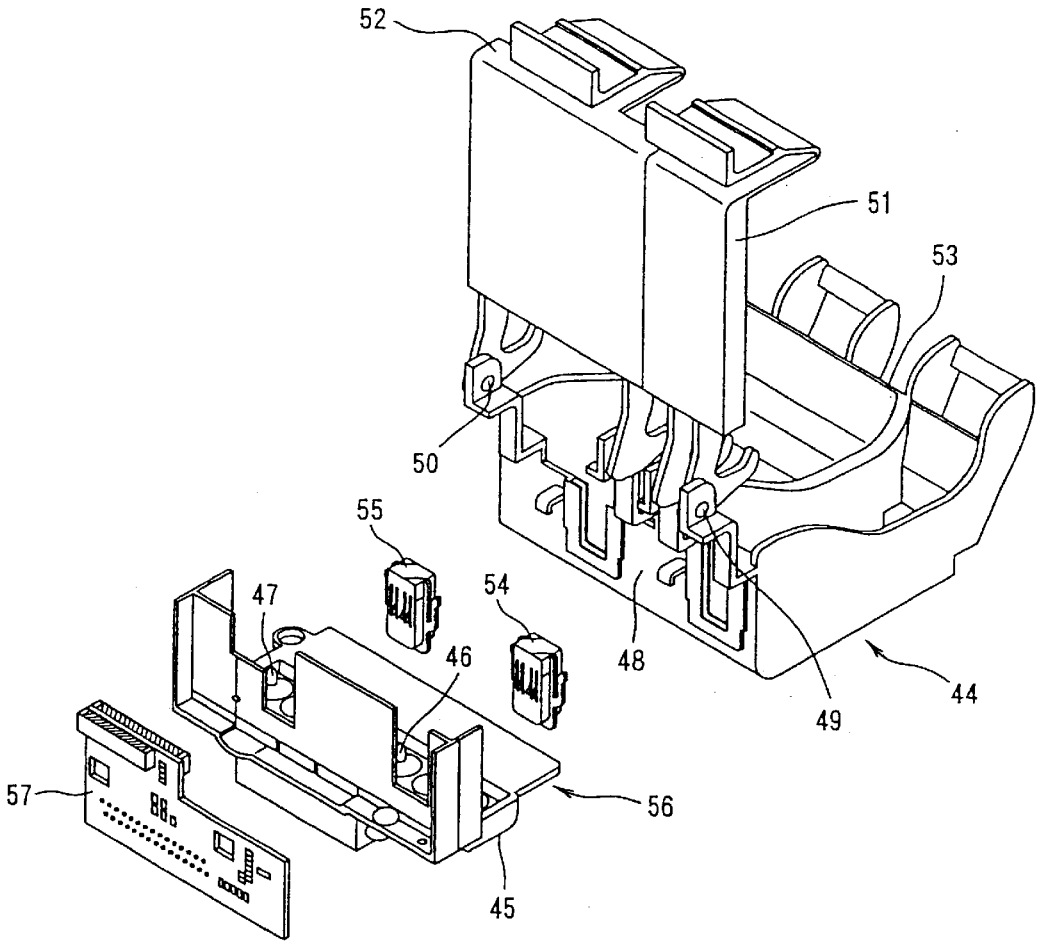
FIG. 7 is a diagram showing a construction of a carriage shown in FIG. 6.

FIG. 7 is a diagram showing a construction of the carriage shown in FIG. 6. As shown in FIG. 7, levers 51 and 52 are mounted rotatably with respect to axes 49 and 50 as fulcrum at the upper edge of a vertical wall 49 closely facing to the ink supply needles 46 and 47 among vertical walls forming the holder 44.

The wall 53 positioned on the side of free edges of the levers 51 and 52 have a slope portion where the bottom surface side is cut diagonally. Further, contact mechanisms 54 and 55 are provided on the vertical wall 48. The contact mechanisms 54 and 55 connected to the above-described contacts provided on the circuit substrate 11 in a condition where the ink-cartridge is attached. Thus, ink-cartridge recording can be performed by using ink within the ink cartridge.

Additionally, a base platform 56 is mounted on the vertical wall 48 of the holder 44. Then, a circuit substrate 57 is mounted on the back surface of the base platform 56. The circuit substrate 57 is electrically connected with the contact mechanisms 54 and 55, resulting in that the circuit substrate 11 and the circuit substrate 57 provided in the ink cartridge are electrically connected.

Figure 8:
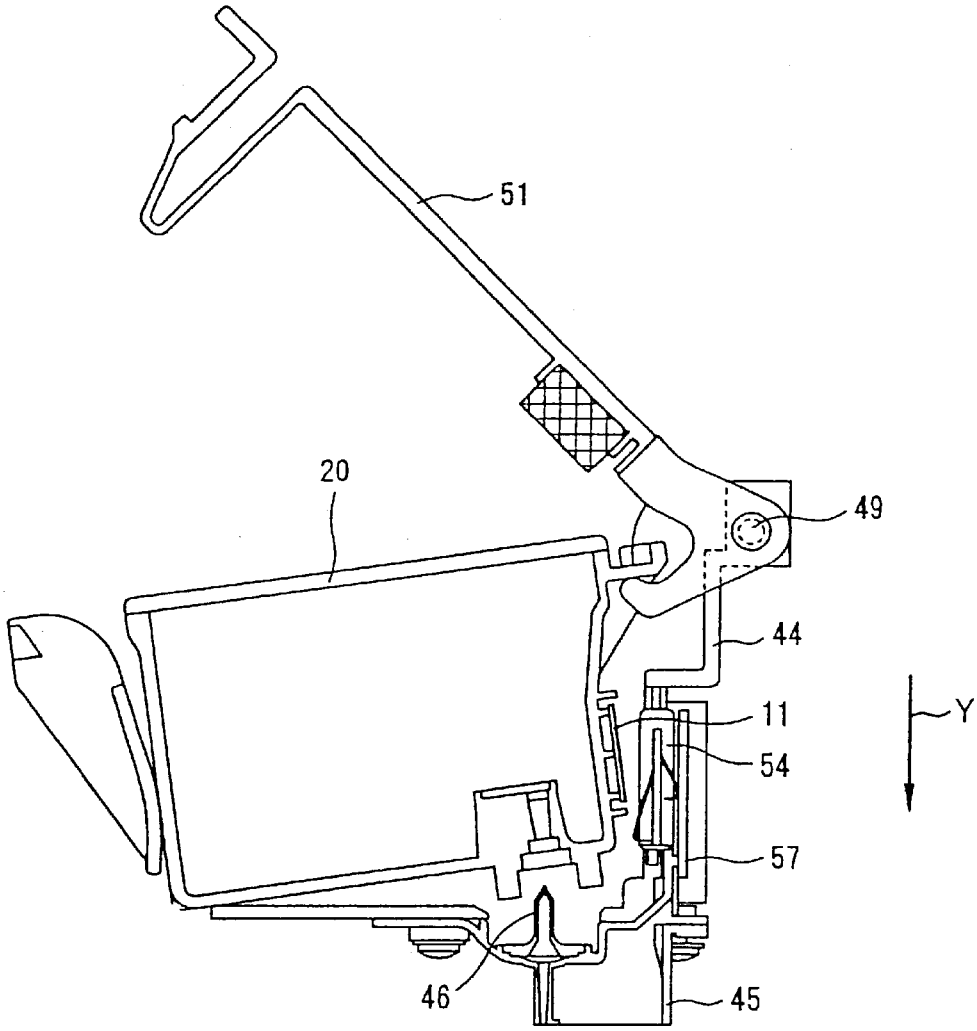
FIG. 8 is a diagram for showing a condition before an ink cartridge is attached to a holder.
Figure 9:
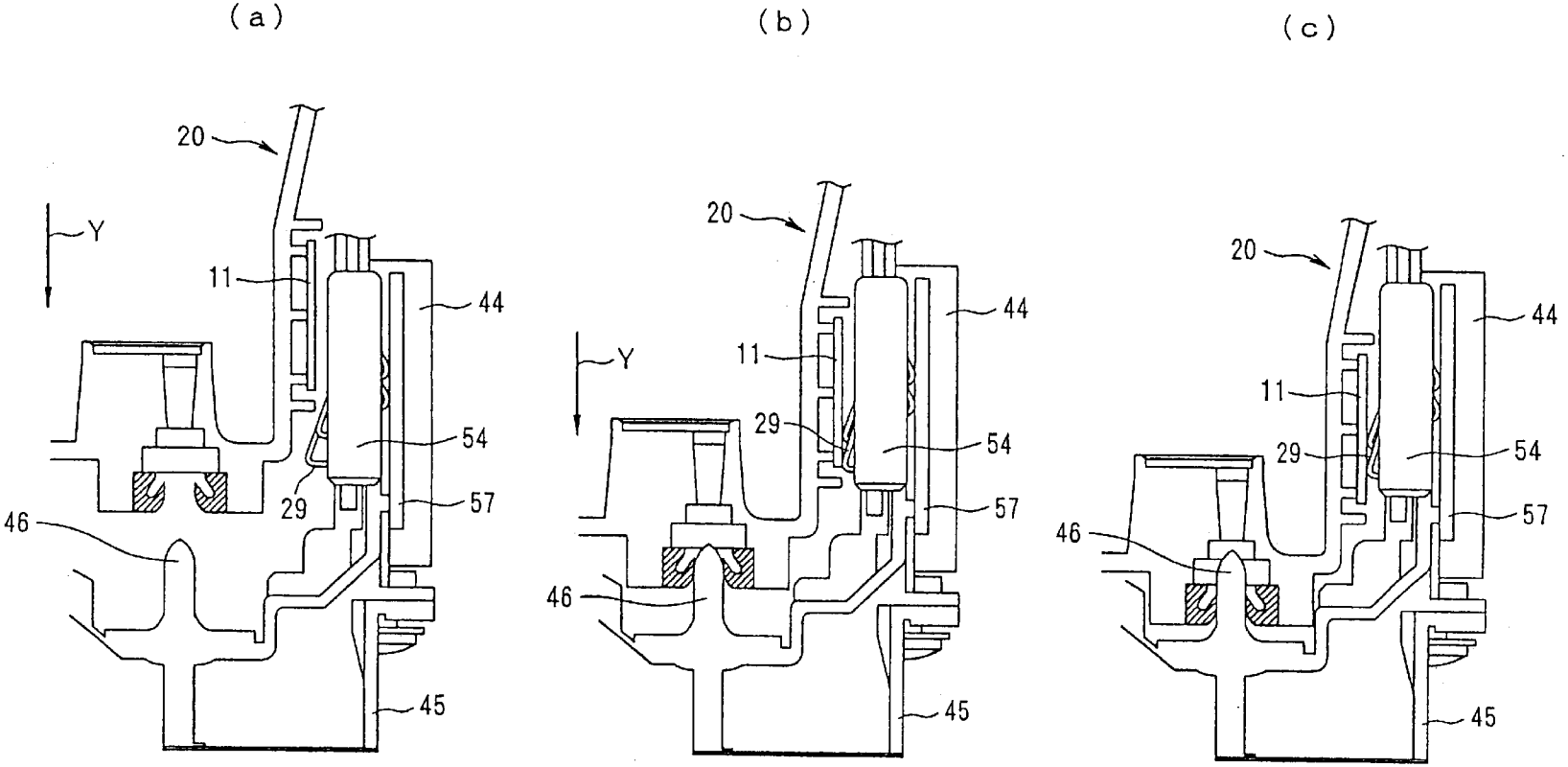
FIG. 9 is a diagram for showing a condition where an ink cartridge is attached to a holder.

FIG. 8 is a diagram showing a condition before the ink cartridge is attached to the holder, while FIGS. 9(*a*) to (*c*) are diagrams showing conditions where the ink cartridge is attached to the holder. As shown in FIG. 8, when the lever 51 is closed in a condition where the ink cartridge 20 is inserted to the holder 44, the ink cartridge 20 is pressed gradually in a direction of an arrow Y. Here, a condition shown in FIG. 9(*a*) is transited to a condition shown in FIG. 9(*c*), and the ink supply needle 46 is inserted inside of the ink cartridge 20. Ink is supplied from the ink cartridge 20 in a condition where the ink supply needle 46 is inserted inside of the ink cartridge 20 and the ink cartridge 20 is attached to the holder 44 completely, that is, in a condition shown in FIG. 9(*c*).

In the condition shown in FIG. 9(*c*), the contact 12 provided on the circuit substrate 11 and the contact 29 on the circuit substrate 57 provided on the side of the holder 44 are electrically connected. Thus, an inkjet printer can read and write data freely to/from the semiconductor integrated circuit 1. More specifically, when the power supply of the printer is ON, "L" is applied to the external terminal P1, while "H" is applied when a read or write operation needs to be performed. It can simplify the logic and contribute to the reduction of the chip size.

Industrial Applicability

As described above, by controlling to shift to the low power consumption mode in response to an end of a printing operation using an ink cartridge, the operation mode can be shifted without giving any effect on the regular operation. In the low power consumption mode, initializing a specified address can attempt the reduction of the power consumption. Additionally, in the low power consumption mode, terminating operations of a sense amplifier for generating signals for reading out stored data, a buffer used for reading out read data, and a latch circuit for latching read data, for example, can reduce the power consumption more.

Further, using a common terminal for instructing to the chip-select function, the initialization function for circuit blocks, and the function for shifting to the stand-by mode can achieve a semiconductor integrated circuit having the reduced number of external terminals.

Furthermore, by storing the remained amount of ink in an ink cartridge, at least, the remained amount of ink cartridge can be always monitored.

What is claimed is:

1. A semiconductor integrated circuit having a low power consumption mode that is lower in power consumption than a regular operation mode performing a regular operation and being implemented in an ink cartridge, said semiconductor integrated circuit comprising:

control means for controlling a shift to said low power consumption mode;

storage means for storing predetermined data at a specified address; and address creating means for sequentially creating addresses specified for said storage means, wherein said sequentially created address is initialized when shifting to the low power consumption mode.

2. A semiconductor integrated circuit according to claim 1, wherein said control means controls a shift to said low power consumption mode in response to a printing operation using said ink cartridge.

3. A semiconductor integrated circuit according to claim 1, wherein the operation of internal circuits is terminated in the low power consumption mode shifted to by said control means.

4. A semiconductor integrated circuit according to claim 3, wherein said internal circuits includes a sense amplifier for creating a signal for reading out data stored by said storage means.

5. A semiconductor integrated circuit according to claim 3 wherein said internal circuits include at least an address decoder for specifying an address in said storage means.

6. A semiconductor integrated circuit according to claim 3 wherein said internal circuits include at least a buffer used for reading out data read out from said storage means.

7. A semiconductor integrated circuit according to claim 3 wherein said internal circuits include at least a latch circuit for latching data read out from said storage means.

8. A semiconductor integrated circuit according to claim 1 wherein a shift to the low power consumption mode by said control means and an initialization of addresses created by said address creating means is performed based on a control signal input from a common external terminal.

9. A semiconductor integrated circuit according to claim 8 wherein said common external terminal is a chip-select terminal.

10. An ink cartridge having a semiconductor integrated circuit according to claim 1, for storing at least a measure of the remaining amount of ink.

11. An inkjet recording device having an ink cartridge according to claim 10 for printing desired image information by using ink supplied from the ink cartridge.

12. A semiconductor integrated circuit according to claim 1 wherein said shift to the said low power consumption mode is further in response to an end of a printing operation using said ink cartridge.

* * * * *